US005284041A

United States Patent [19]

Christensen et al.

[11] Patent Number: 5,284,041

[45] Date of Patent: Feb. 8, 1994

[54] METHOD FOR BENDING TUBES USING SPLIT DIE

[75] Inventors: David M. Christensen, Amana; Eugene H. Schuchert, Iowa City; Richard N. Walker, Victor, all of Iowa

[73] Assignee: Amana Refrigeration, Inc., Amana, Iowa

[21] Appl. No.: 59,684

[22] Filed: May 10, 1993

[51] Int. Cl.[5] ..... B21D 7/04

[52] U.S. Cl. ..... 72/159; 72/157; 72/369

[58] Field of Search ..... 72/149, 150, 152, 153, 72/154, 157, 158, 159, 369, 370; 29/890.053

[56] References Cited

U.S. PATENT DOCUMENTS

| | | | |
|---|---|---|---|
| 1,873,939 | 8/1932 | Mason et al. | 72/150 |
| 2,406,838 | 9/1946 | Kepler | 72/369 |
| 2,814,327 | 11/1957 | Charlton | 72/159 |
| 3,657,911 | 4/1972 | Clarke et al. | 72/157 |
| 4,063,441 | 12/1977 | Eaton | 72/154 |
| 4,112,728 | 9/1978 | Noack et al. | 72/154 |
| 5,142,895 | 9/1992 | Schuchert | 72/150 |
| 5,187,963 | 2/1993 | Sutton et al. | 72/157 |

FOREIGN PATENT DOCUMENTS

| | | | |
|---|---|---|---|
| 0141331 | 11/1980 | Japan | 72/149 |

*Primary Examiner*—Lowell A. Larson
*Assistant Examiner*—Michael J. McKeon
*Attorney, Agent, or Firm*—William R. Clark; Richard M. Sharkansky

[57] ABSTRACT

Method and apparatus for bending metal tubes such as for furnace heat exchangers. After the bend die is rotated 180° to make a bend, an upper section of the bend die is split from a lower section, and the upper section is then rotated approximately 90°. In such manner, a portion of the upper section is displaced laterally to vacate a region directly above the lower section. Therefore, in moving the tube forwardly to a new location for a subsequent bend operation, a portion of a previous bend passes through the vacated region thereby enabling sequential bend angles that are less restricted than without rotating the upper section of the split die.

17 Claims, 6 Drawing Sheets

METHOD FOR BENDING TUBES USING SPLIT DIE

BACKGROUND OF THE INVENTION

The field of the invention generally relates to a method of bending tubes such as for making heat exchangers, and more particularly relates to a method of splitting a bend die to reduce vertical spacings between adjacent parallel segments of a tube heat exchanger.

As is well known, residential furnaces have been constructed using tubular heat exchangers instead of the more conventional clam-shell heat exchangers. With such arrangement, a plurality of stainless steel or aluminized steel tubes are arranged within a heat exchange chamber of a furnace and one end of each is fired by an individual burner. The hot combustion gases pass through the tubes, and heat is transferred to household return air that is forced across outside surfaces of the tubes.

In the above-described furnace arrangement, it is desirable to maximize the heat exchange surface area within the confined or restricted volume inside the heat exchange chamber. It may also be desirable to minimize the size, and in particular, the height of the heat exchange chamber so that the furnace can be used at installations that have height restrictions. For example, a furnace 40 inches high can be sold into markets where 48 inch furnaces will not fit. Accordingly, tubes have been bent into serpentine configurations with parallel straight segments to increase the length of tubes that will fit into a heat exchange chamber. In particular, tubes have been rotated between successive bends so that the parallel straight segments are not linearly aligned. Therefore, when the parallel segments are viewed from their ends, the bends can be seen to zigzag back and forth. The zigzagging is desirable because it promotes turbulence in the return air that is forced across the outside surfaces of the tubes. Thus, heat transfer is enhanced.

Another reason for zigzagging relates to the apparatus used to bend the tubes. In particular, one apparatus is described in U.S. Pat. No. 5,142,895. A tube is seated in the groove of a rotary bend die, and a pressure die and clamp die are moved up against the opposite side of the tube. The bend die and the clamp die are then rotated approximately 180 degrees about a vertical axis while the pressure die moves forward linearly carrying the tube tangentially to the bend point. The clamp die and pressure die are then retracted and returned to their respective initial positions, and the tube is repositioned with respect to the bend die so that another 180 degree bend can be executed. The tube may also be rotated to elevate the just formed segment above the path used by the clamp die on the next bend. This tube rotation leads to segments that zigzag rather than being disposed in a single plane. The apparatus further had a split bend die wherein an upper section was elevated from a lower section to remove the tube which had been formed with controlled wrinkles past the 180 degree tangent point.

One drawback of the above described system was that the height between adjacent horizontal segments was limited to certain minimums because the tube rotation angle or zigzag angle was restricted to certain minimums. More specifically, as the tube was moved forward to reposition it for the next bend, the angle between successive bends or segments had to be relatively large such as 108 degrees to clear the upper section of the bend die. Raising the upper section of the bend die aided by making the angle less restrictive, but the angle was still larger than desirable for certain applications. For a given set of conditions such as tube diameters, horizontal spacings between burners, and center line radii for bends, the relatively large angle between successive bends resulted in relatively large vertical spacings between successive segments. Therefore, for a given low profile furnace, the segments could not be packed densely enough to attain a desired heat transfer characteristic.

SUMMARY OF THE INVENTION

In accordance with the invention, a method of preparing for a next bend in a tube bending system having a bend die with first and second mating section comprises the steps of separating the first and second sections in a first direction and then displacing at least a portion of the second section in a direction substantially orthogonal to the first direction to vacate a region in the first direction from the first section. The next step is moving the tube through at least a portion of the vacated region to reposition the tube with respect to the first section of the bend die in preparation for another bending operation. The following step is moving the second section of the bend die into mating relationship with the first section of the bend die. The displacing step may comprise a step of rotating the second section of the bend die about an axis substantially parallel with the first direction.

The invention may also be practiced by a method of bending a tube comprising the steps of seating the tube tangentially in a tube groove of a bend die, clamping the tube to the bend die with a clamp die, moving the tube tangentially toward the bend die with a pressure die while rotating the bend die and the clamp die to form a bend in the tube, and then splitting upper and lower sections of the bend die by displacing the upper section upwardly and laterally to vacate a region directly above at least a portion of the lower section. The next steps are altering the spacial relationship between the tube and the lower section of the bend die in preparation for forming another bend wherein the tube passes through at least a portion of the vacated region, and rejoining the upper and lower bend die sections. Preferably, the splitting step comprises the steps of elevating the upper section above the lower section and then rotating the upper section about a vertical axis. The altering step preferably comprises a step of moving the tube forwardly with respect to the lower section, and rotating the tube. The bends are preferably 180 degrees. Although it is not necessary for taking advantage of the inventive steps, it is preferable that the bend die have elongated indentations to form controlled wrinkles on the tube, and that the controlled wrinkles span an arc greater than 180 degrees.

With such method, the rotation of the upper section of the bend die after splitting vacates a region above the lower section. Thus, as the tube is moved forwardly in preparation for another bending operation, a previous bend is permitted to pass through the vacated region. The advantage is that the angle between consecutive bends can be made smaller than without rotating the upper section, and the heat exchange surface area can be more densely packed into a heat exchange chamber. More specifically, consecutive bends are made at an angle to one another by rotating the tube between bends. The angle raises previously formed segments from the path of the clamp die, and also staggers the segments back and forth to create more turbulence of return air during use in a furnace. By removing the upper section from immediately above the lower section, the vertical spacings between adjacent segments can be reduced.

BRIEF DESCRIPTION OF THE DRAWINGS

The foregoing objects and advantages will be more fully understood by reading the following Description of the Preferred Embodiment with reference to the drawings wherein.

DESCRIPTION OF THE PREFERRED EMBODIMENT

Figure 1:
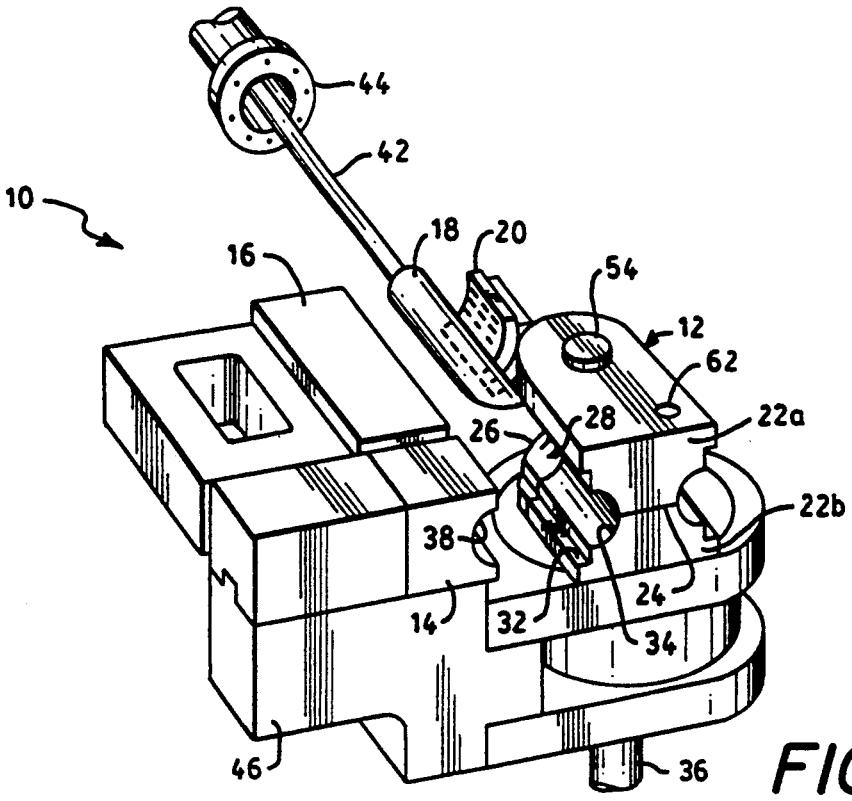
FIG 1 is a perspective view of tube bending tooling.
Figure 6:
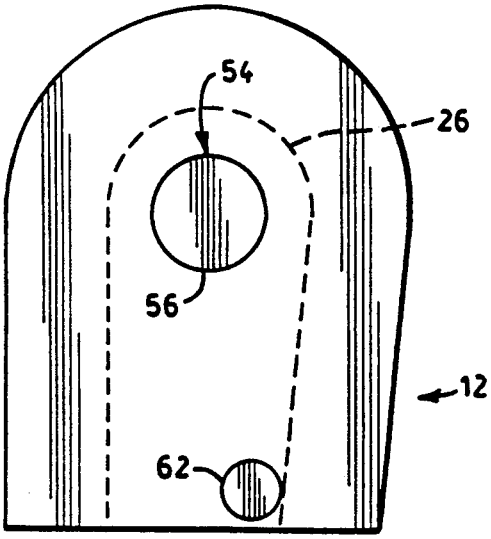
FIG. 6 shows a top view of a bend die.

Referring to FIG. 1, tube bending tooling 10 includes bend die 12, clamp die 14, pressure die 16, plastic plug mandrel 18 and plastic follower 20. As will be described in detail later herein, bend die 12 is a split die having upper and lower sections 22*a* and *b* which, as shown in FIG. 8, can be vertically separated at a mid portion 24. When sections 22*a* and *b* are engaged or mated together, they form a block having a circular end with a horizontal tube groove 26 that has generally elliptical curvature and is adapted for receiving a tube 30 or pipe of predetermined diameter. Tube groove 26 here has a plurality of vertically elongated controlled-wrinkle indentations 28 or serrations that are disposed in an arc greater than 180°. That is, serrations 28 extend beyond the tangents of the bend arc or bend portion of bend die 12. Referring also to FIG. 6, the arc of tube groove 26 is slightly larger than 180 degrees to permit the controlled wrinkles 48 to span an arc greater than 180 degrees and to allow for overbend to compensate for springback. Grip section 32 also has a tube groove 34 conforming to groove 26 except that it is linear and extend tangentially from tube groove 26. As is conventional, bend die 12 is mounted to a rotary drive 36 such that bend die 12 can be rotated during a bending operation. Also referring to FIGS. 7 and 8, a hold down mechanism 54 includes a post 56 that is locked from the underside to secure upper section 22*a* and lower section 22*b* together during a bending operation as bend die 12 is rotated approximately 180 degrees. Further, as will be described in detail later herein, bend die 12 has a post 62 about which section 22*a* can be rotated after splitting bend die 12.

Clamp die 14 and pressure die 16 have respective linear tube grooves 38 and 40 (FIG. 3) that ma preferably be elliptically shaped and adapted to receive a tube 30. Initially, pressure die 16 and clamp die 14 are lined side by side with tube grooves 38 and 40 linearly aligned, and they are spaced from the axis defined by tube groove 26 and grip section 32 as shown in FIG. 1. A plastic follower 20 having an arcuate surface generally conforming to the outer diameter of the tube being bent is mounted behind the bend die 12 diametrically opposite pressure die 16. A mandrel rod 42 with a plastic plug mandrel 18 on the end extends forwardly with bend die 12 and plastic follower 20 on one side, and pressure die 16 and clamp die 14 on the opposite side. Supporting and drive mechanisms for bend die 12, pressure die 16, clamp die 14, mandrel rod 42 and plastic follower 20 are not described in detail herein because they are conventional, and an explanation of them is not necessary for an understanding of the invention.

Figure 2:
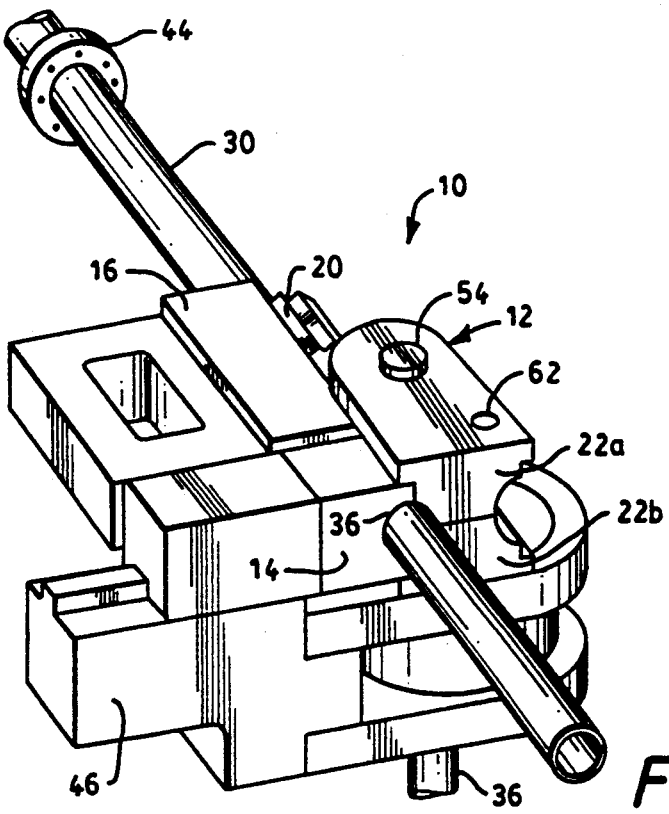
FIG. 2 is the tooling of FIG. 1 in the first step of a bending operation with the tube inserted.

Referring to FIG. 2, the first step in a bending operation is to insert tube 30 onto mandrel rod 42. Tube 30 is held in place there by collet 44. Pressure die 16 and clamp die 14 are then moved laterally so as to engage tube 30 as shown. In particular, clamp die 14 is moved diametrically opposite grip section 32 and mates therewith. Accordingly, clamp die 14 and grip section 32 are interlocked, and tube 30 is firmly clamped therebetween. In FIG. 2, face edges of clamp die 14 can be seen to seat in mating channels of bend die 12. Alternately, face portions of clamp die 14 and bend die 12 can be mated or interlocked using a tongue and groove arrangement to reduce the profile of bend die 12. As will be apparent later herein, a bend die of lower profile enables the use of smaller angles between consecutive bends. Similarly, the portion of tube 30 immediately behind clamp die 14 is received in tube groove 40 of pressure die 16. Lateral pressure exerted on tube 30 by pressure die 16 is restrained by plastic follower 20.

Figure 3:
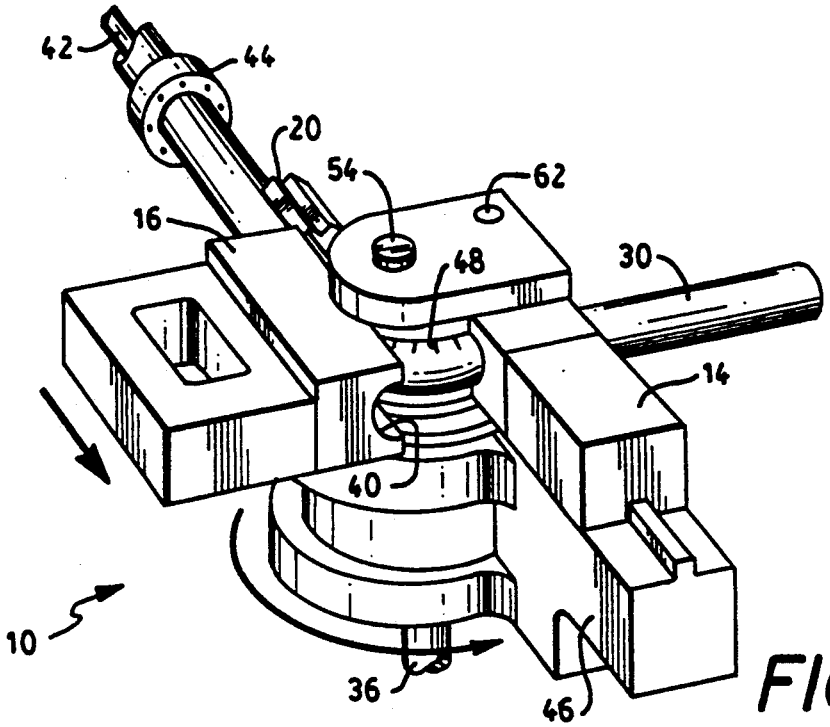
FIG. 3 depicts the second step in a bending operation after the bend die and clamp die have been rotated approximately 90 degrees.

Referring to FIG. 3, bend die 12 and clamp die 14 are rotated in unison while pressure die 16 drives linearly forward. Tube 30, which remains held by collet 44, is driven forwardly to the tangent or bend point of die 12. Plastic follower 20 has a relatively low coefficient of friction such that tube 30 readily slides over it while plastic follower 20 continues to restrain the pressure of pressure die 16. During a bending operation, tube 30 continues to be clamped between clamp die 14 and grip section 32 as clamp die 14 is driven by a suitable rotating arm 46. As tube 30 bends around rotating bend die 12, the inside of the tube bend is compressed and the metal flows into the elongated vertical serrations 28 thereby forming controlled-wrinkles 48.

Figure 4:
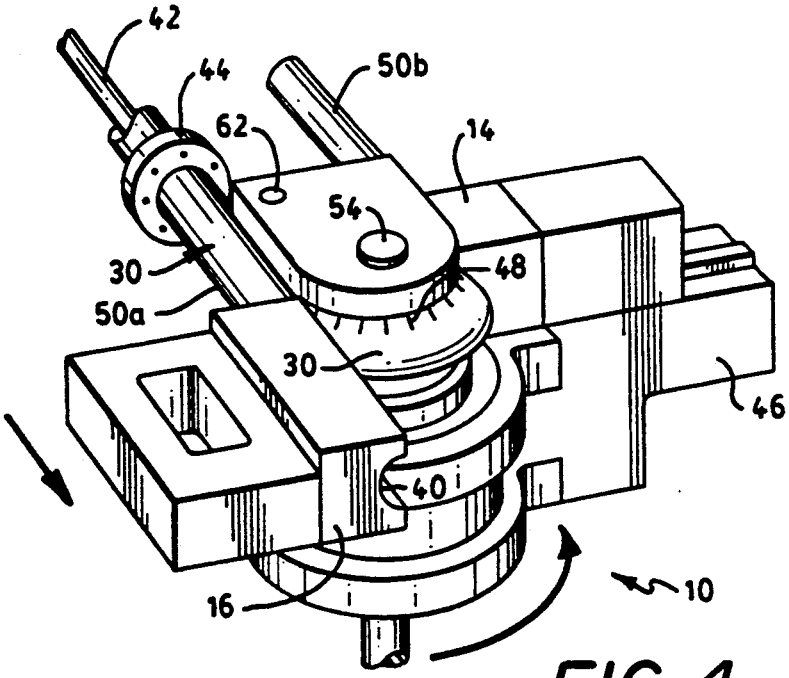
FIG. 4 depicts the conclusion of a bending operation after the bend die and clamp die have been rotated approximately 180 degrees.

Referring to FIG. 4, tube 30 is shown after it has been bent a full 180° such that segments 50*a* and 50*b* are parallel. In such state, bend die 12 has rotated approximately 180° from the initial orientation, and likewise clamp die 14 has been rotated 180° about the central axis of bend die 12 such that tube groove 38 now faces in the opposite direction from the initial orientation, and still clamps tube 30 to grip section 32 of bend die 12. Also, pressure die 16 is shown to have linearly traversed to its forward-most position where it still engages tube 30 at its tangent point to bend die 12. During the entire bending operation, plastic plug mandrel 18 remains in a stationary position within tube 30, and thereby functions to limit or control the collapse of tube 30. More specifically, plastic plug mandrel 18 does not advance around the bend as a multiple ball mandrel would, but rather remains stationary with its tip being in the approximate region of the tangent or bend point. Plastic mandrel 18 is subject to wear that particularly occurs on the outside as the wall of tube 30 slides against it, but plastic plug mandrels 18 are relatively inexpensive to replace. As the plastic wears, the plastic plug mandrel 18 is moved slightly forward by a simple adjustment so that the tip remains properly positioned to control collapse to the desired degree. In an alternate embodiment, tubes 30 may be bent without using a plastic plug mandrel 18 or any other internal supporting structure. In other words, tubes 30 can be bent without any collapse suppressing structure on the inside. Also, tubes 30 can be bent without a bend die 12 having elongated serrations 28 to provide controlled-wrinkles 48. This concludes the description of a single bending operation.

Figure 5:
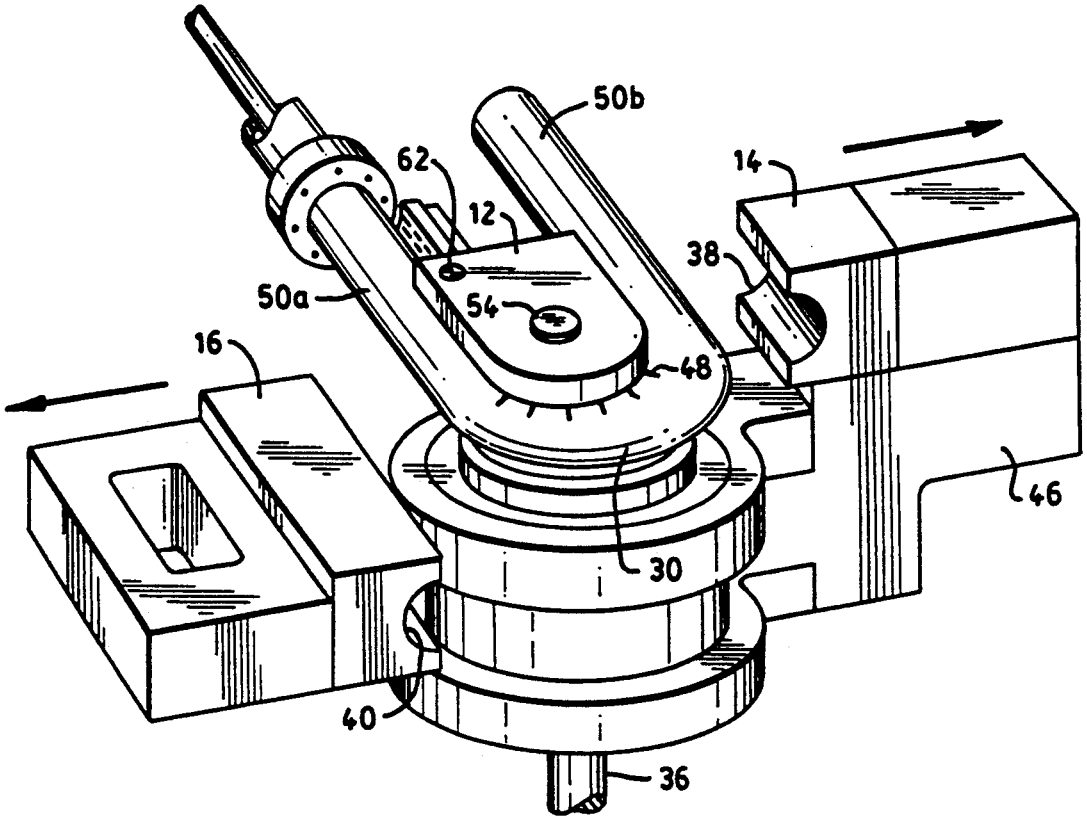
FIG. 5 shows the clamp die and pressure die in a retracted position commencing the steps in preparing for another bending operation.

In preparation for a sequential or subsequent bending operation on tube 30, pressure die 16 and clamp die 14 are first retracted from bend die 12 in respective opposite directions to release tube 30 as shown in FIG. 5. Clamp die 14 is also lowered so at clear tube 30 as clamp die 14 is rotated back to its initial position as shown in FIG. 1. Still referring to FIG. 5 and also to FIGS. 7 and 8, bend die 12 is split into upper section **22*a* and lower section 22*b* to release tube 30. As described in U.S. Pat. No. 5,142,895 which is hereby incorporated by reference, splitting of bend die 12 may be required to remove tube 30 if bend die 12 has elongated serrations 28 and the controlled-wrinkles 48 formed thereby extend beyond the 180° tangent points. However, even if elongated serrations 28 are not present or the controlled-wrinkles 48 do not extend beyond the 180° tangent points, splitting of bend die 12** in a manner to be described has significant advantages in accordance with the present invention.

Figure 7:
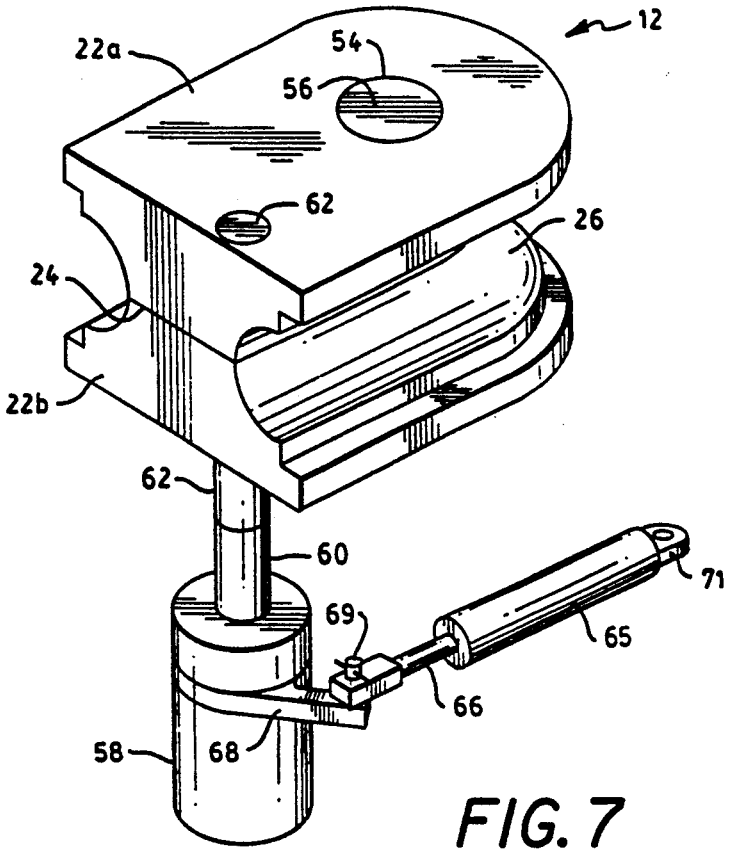
FIG. 7 shows a perspective view of the bend die with apparatus for lifting and rotating the upper section.
Figure 8:
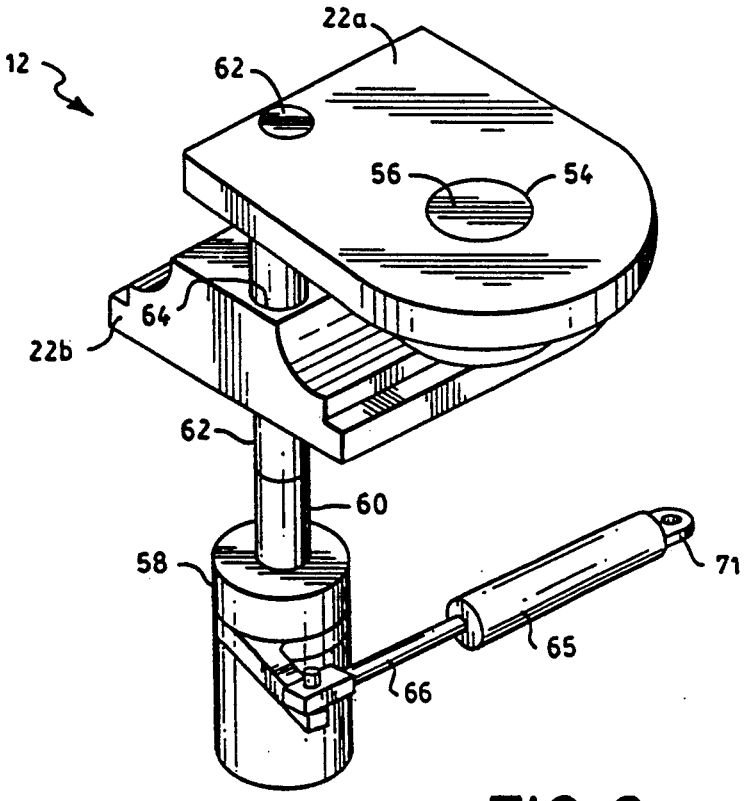
FIG. 8 show the upper section after lifting and rotating.

Referring to FIGS. 6 and 7, top and perspective views of bend die 12 are shown. During a bending operation as shown in FIGS. 2–4, hold down mechanism 54 is engaged to prevent separation of upper section **22*a* from lower section 22*b*. However, during the preparation for the next sequential bending operation on tube 30, hold-down mechanism 54 is disengaged and upper section 22*a* is free to be lifted or split from lower section 22*b*. As shown in FIGS. 7 and 8, a lifting mechanism 58 such as a hydraulic cylinder with a plunger 60 is connected to post 62 that is fixed to upper section 22*a*, but freely passes through a corresponding aperture 64 in lower section 22*b*. When a bending operation is completed as shown in FIG. 4, lifting mechanism 58 is actuated and plunger 60 lifts upper section 22*a* a predetermined distance, such as, for example 0.8 inches to 1.5 inches. Simultaneously or sequentially, independent pneumatic cylinder 65 is actuated, and plunger 66 operates with arm 68 through a suitable linkage 69 to rotate lifting mechanism 58 and correspondingly upper section 22*a* through a predetermined angle, such as, for example, 90 degrees. More specifically, linkage 69 may be a pin that permits rotation of arm 68 with respect to plunger 66, and cylinder 65 is pivotally mounted by eyelet 71. FIG. 8 shows the orientation of upper section 22*a* with respect to lower section 22*b* after upper section 22*a*** has been rotated.

Figure 9:
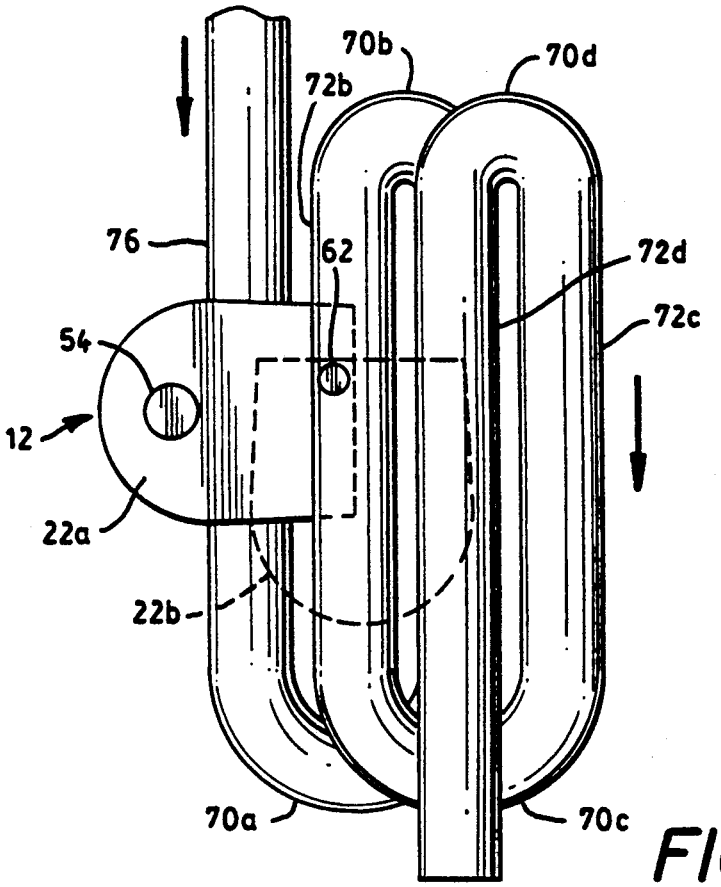
FIG. 9 shows a top view of the tube traveling forward with respect to the bend die.
Figure 10:
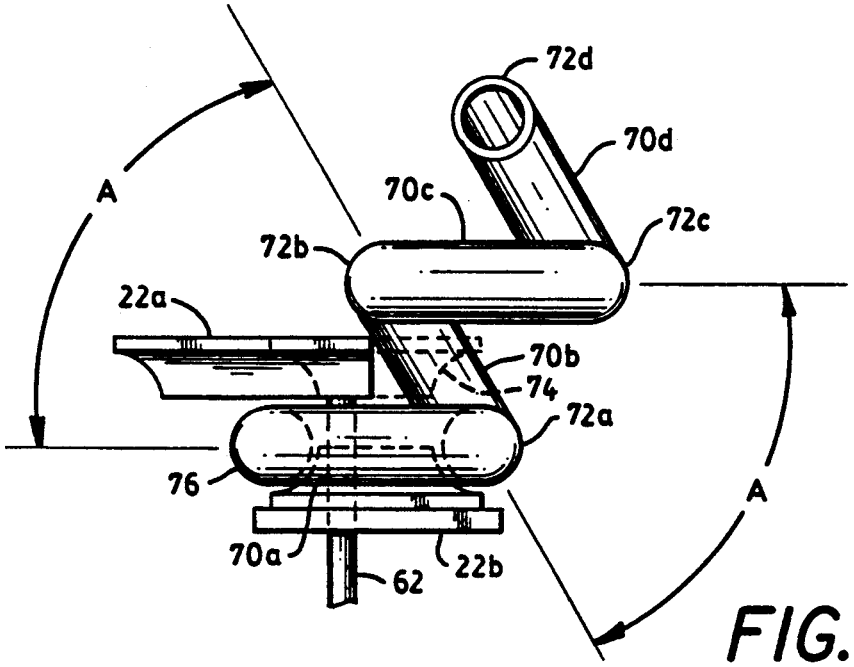
FIG. 10 shows a front view of the tube passing through a region vacated by rotating the upper section of the bend die.

Now, referring to FIG. 9, the next step in the preparation for a subsequent bending operation is to drive tube 30 forwardly with collet 44. In particular, FIG. 9 shows tube 30 with a plurality of previously executed bends **70*a–d*. Tube 30 is driven forward far enough so that bend die 12 with upper section 22*a* in a rotated orientation is behind the rear of bends that are presently in the rear position, here bends 70*b* and *d*. Thus, bend die 12 is behind already bent segments 72*a–d* and bends 70*b* and *d*, and tube 30 is free to be rotated by collet 44 in a manner to be described. Referring specifically to FIG. 10, it can be seen that as tube 30 moves forwardly, the immediately prior bend 70*b* is able to clear upper section 22*a* in its rotated orientation. It can also be seen that if upper section 22*a* had not been rotated in accordance with the present invention, but rather merely been split upwardly and was positioned directly above lower section 22*b*, the angle A between successive bends would have to be munch larger for bend 70*b* to clear bend die upper section 22*a*. Thus, upper section 22*a* has been displaced laterally by rotation about post 62, and a region 74 is vacated above at least a portion of lower section 22*b*. Therefore, as tube 30 moves forwardly in preparation for locating it for a subsequent bending operation, tube 30 and in particular bend 70*b* passes through at least a portion of the vacated region 74. For example, with one particular set of parameters, angle A has a lower limit of 108° when upper section 22*a* is not rotated as shown in FIG. 5, but has a lower limit of 60° when upper section 22*a* is rotated. Thus, by splitting bend die 12 and rotating upper section 22*a* as described herein, the angle A between successive bends can be reduced thereby enabling the vertical spacings between successive segments 72*a–d*** to be reduced. As a result, heat exchange surface area can be more densely packed into a given volume of a heat exchange chamber, thereby reducing the height of the furnace for given heat transfer requirements.

Referring again to FIG. 5, clamp die 14 is lowered and rotated approximately 180° clockwise back around to its initial position as shown in FIG. 1, and also pressure die 16 is returned to its initial position. Lowering of clamp die 14 enables it to pass under tube 30 which is travelling forwardly a described above.

Referring again to FIGS. 9 and 10 and in order to reduce manufacturing time, tube 30 may be rotated counterclockwise through a predetermined angle A simultaneous to the returning of clamp die 14 and pressure die 16 to their initial positions as shown in FIG. 1. Without rotating upper section **22*a* as shown in FIG. 8, tube 30 must travel forward so that previous bends 70*b* and *d* clear bend die 12 before rotation of tube 30 about section 76. By displacing a portion of upper section 22*a* laterally by rotation about post 62, it may, under certain dimensions and bending parameters, be possible to begin rotating tube 30 about section 76 before rear bends 70*b* and *d* clear bend die 12 in the journey forward. This simultaneous execution of different preparation steps would save fabrication time. Under other conditions and circumstances, it may be desirable or necessary to wait until rear bends 70*b* and *d* clear bend die 12 before commencing rotation of tube 30**.

Figure 11:
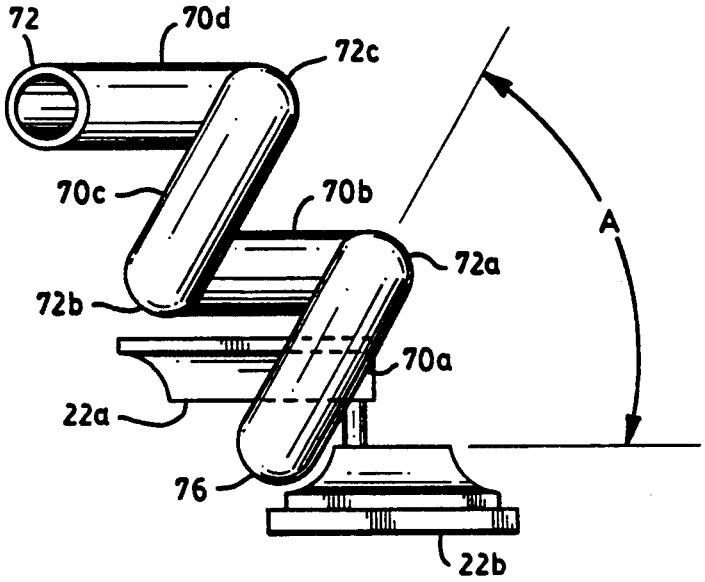
FIG. 11 shows the tube after rotation through a predetermined angle A in preparation for a next bending operation.

Referring to FIG. 11, tube 30 is shown after being rotated counterclockwise through angle A about section 76. Now, upper section **22*a* is rotated counterclockwise back above lower section 22*b* by withdrawing plunger 66 into cylinder 65, and both the upper and lower bend die sections 22*a* and 22*b*** are rotated approximately 180° counterclockwise in conventional manner so that the arcuate portion of bend die 12 is toward the rear as shown in FIG. 1. If tube 30 was moved so that rear bends 70*b* and d were in front bend die 12, tube 30 would now be moved slightly to the rear so that bend die 12 is aligned with rear bends 70*b* and *d*, assuming the next bend was to be made so that the parallel segments including segments 70*a–d*are of equal length. It may, however, be desirable in certain applications to have segments of different lengths, as well as different bend angles. Upper section 22*a* is next lowered by withdrawing plunger 60 into lifting mechanism 58, and hold-down mechanism 54 is actuated to lock upper section 22*a* to lower section 22*b*. Thus, tooling 10 is returned to the initial configuration as shown in FIG. 1, and bend die 12 is ready to commence a subsequent bending operation.

The method of splitting bend die 12 and displacing the upper section 22*a* laterally to vacate a region 74 through which the tube 30 passes between bending operations has advantages in many applications. One particular application is for bending tubes to make heat exchangers for furnaces where it is desirable to pack the segments 70*a–d* and corresponding surface areas densely into a heat exchange chamber. The tube parameters such as length, diameter, wall thickness and material may desirably vary for different furnace applications. Also, the bending parameters such as center line radius, length of segments, degree of bend (eg. 180°), angle between bends and number of bends may also desirably vary for different furnace applications. In one embodiment, the tubes 30 are 1.25 inches in diameter and the bends have a center line radius of 1.5 inches. In such arrangement, the upper section 22*a* must be lifted at least 0.75 inches to clear the tube 30 during rotation, and the upper section 22*a* may preferably be raised slightly more than 0.8 inches. If upper section 22*a* is raised higher, or is thicker, the spacing between alternate bends may be increased to enable bend die 12 to be cleared during the process of preparing for the next bend. For example, see FIG. 11. The tubes 30 may be twenty feet long and have 5 bends. The angle A between bends may be approximately 6020 , and bend angles A may be programmed to stagger or more randomly locate segments 72*a–d* to increase turbulence and heat transfer.

This concludes the description of the preferred embodiment. A reading of it by one skilled in the art will bring to mind many alterations and modifications that do not depart from the spirit and scope of the invention. Therefore, it is intended that the invention be limited only by the appended claims.

What is claimed is:

1. In a tube bending system comprising a bend die having first and second mating sections, a method of preparing for a next one in a sequence of bending operations on a tube, comprising the steps of:

lifting said second section to a region above said first section to split said first and second sections of said bend die;

rotating said section of said bend die about a vertical axis to displace at least a portion of said second section from said region;

moving said tube through at least a portion of said region from which said second section is displaced during said rotating step to reposition said tube with respect to said first section of said bend die in preparation for said next bending operation; and moving said second section of said bend die into mating relationship with said first section of said bend die.

2. The method recited in claim 1 wherein said tube moving step comprises a step of rotating said tube.

3. A method of bending a tube comprising the steps of:

seating said tube tangentially in a tube groove of a bend die;

clamping said tube to said bend die with a clamp die;

moving said tube tangentially toward said bend die with a pressure die while rotating said bend die and said clamp die to form a bend in said tube;

splitting upper and lower sections of said bend die by moving said upper section upwardly to a region above said lower section;

rotating said upper section about a vertical axis of said bend die to displace at least a portion of said upper section from said region;

altering the spacial relationship between said tube and said lower section of said bend die in preparation for forming another bend wherein said tube passes though at least a portion of said region from which said upper section is displaced during said rotating step; and rejoining said upper and lower bend die sections.

4. The method recited in claim 3 wherein said altering step comprises a step of moving said tube forwardly with respect to said lower section, and rotating said tube.

5. The method recited in claim 3 wherein said bend is approximately 180 degrees.

6. The method recited in claim 3 wherein said bend die has elongated indentations to form controlled wrinkles on said tube.

7. The method recited in claim 6 wherein said controlled wrinkles span an arc greater than 180 degrees.

8. The method recited in claim 3 further comprising the steps of reexecuting all of the steps a plurality of times to form a heat exchanger having a plurality of substantially parallel staggered segments.

9. A method of bending a metal tube at a plurality of locations to form a serpentine shaped heat exchanger adapted for use in a furnace, said method comprising the steps of:

seating said tube tangentially in a tube groove of a bend die;

clamping said tube to said bend die with a clamp die;

moving said tube tangentially toward said bend die with a pressure die while rotating said bend die and said clamp die to form a bend in said tube;

splitting upper and lower sections of said bend die by moving said upper section upwardly to a region above said lower section;

rotating said upper section about a vertical axis of said bend die to displace at least a portion of said upper section from said region;

relocating said tube with respect to said lower section of said bend die by passing said tube though at least a portion of said region from which said upper section is displaced during said rotating step in preparation for forming another bend;

replacing said upper bend die section onto said lower bend die section; and executing the above steps to form another bend in said tube and prepare for forming still another bend.

10. The method recited in claim 9 wherein said relocating step comprises steps of moving said tube forwardly and rotating said tube.

11. The method recited in claim 9 wherein said bend is approximately 180 degrees.

12. The method recited in claim 9 wherein said bend die has elongated indentations to from controlled wrinkles on said tube.

13. The method recited in claim 12 wherein said controlled wrinkles span an arc greater than 180 degrees.

14. The method recited in claim 9 further comprising the steps of reexecuting the above steps to form a heat exchanger having a plurality of substantially parallel staggered segments.

15. The method recited in claim 14 wherein said tube is rotated through a predetermined angle less than 90 degrees between successive bends.

16. The method recited in claim 15 wherein said angle is approximately 60 degrees.

17. The method recited in claim 9 wherein said tube has a diameter of approximately 1.25 inches.

* * * * *